US008333028B1

(12) United States Patent
Karfiol et al.

(10) Patent No.: US 8,333,028 B1
(45) Date of Patent: Dec. 18, 2012

(54) FIREARM MODE SELECTION MECHANISM

(75) Inventors: Yury Karfiol, Brooklyn, NY (US); John Goliber, Leonia, NJ (US)

(73) Assignee: Kimber IP, LLC, Yonkers, NY (US)

( * ) Notice: Subject to any disclaimer, the term of this patent is extended or adjusted under 35 U.S.C. 154(b) by 157 days.

(21) Appl. No.: 13/017,105

(22) Filed: Jan. 31, 2011

(51) Int. Cl.
*F41A 17/00* (2006.01)

(52) U.S. Cl. ..... 42/70.01; 42/70.05; 89/148

(58) Field of Classification Search ..... 42/70.01, 42/70.04, 70.05, 70.08; 89/148
See application file for complete search history.

(56) References Cited

U.S. PATENT DOCUMENTS 4,414,769 A * 11/1983 Mueschke ..... 42/70.01
4,590,697 A * 5/1986 Ruger et al. ..... 42/70.08
4,681,020 A * 7/1987 Polanecky ..... 89/138
6,588,136 B2 * 7/2003 Baker et al. ..... 42/70.05
8,132,496 B2 * 3/2012 Zukowski ..... 89/142

* cited by examiner

*Primary Examiner* — Gabriel Klein
(74) *Attorney, Agent, or Firm* — Caesar, Rivise, Bernstein, Cohen & Pokotilow, Ltd.

(57) ABSTRACT

A mode selection mechanism for a firearm is provided including a lever having an exposed surface and an inner surface and a pivot pin and a detent pin depending from the inner surface, the pivot pin extending through a orifice in the frame, the detent pin extending generally parallel to the pivot pin. The lever is pivotable from a first position to a second position about the pivot pin, wherein the detent pin moves in an arc-shaped aperture in the frame. A flexible stop includes an open ring of spring metal and is disposed in a ring orifice in the frame. The detent pin is disposed against the flexible stop wherein, as the lever is moved from the first position to the second position, the flexible stop compresses and then uncompresses thereby creating a detent.

8 Claims, 8 Drawing Sheets

FIREARM MODE SELECTION MECHANISM

BACKGROUND OF THE INVENTION

The present invention is directed to a mode selection mechanism for a firearm. Mode selection mechanisms may be present for various reasons for firearms. For example, such a mode selection mechanism may be used to engage and disengage a firearm safety. It would be highly beneficial to have a simple, reliable, easy to maintain, and inexpensive mode selection mechanism that may be used, for example, to engage and disengage a firearm safety.

All references cited herein are incorporated herein by reference in their entireties.

BRIEF SUMMARY OF THE INVENTION

A mode selection mechanism for a firearm such as an automatic pistol is provided. In a preferred embodiment, the mode selection mechanism includes a lever, a flexible stop and associated apertures in the frame of the firearm. The lever has an exposed surface for receiving a digit, such as a thumb of a user, and an inner surface. A pivot pin and a detent pin depend from the inner surface of the lever where the pivot pin extends through an orifice in the frame and the detent pin extends generally parallel to the pivot pin. The lever is pivotable from a first position to a second position about the pivot pin. The detent pin moves in an arc-shaped aperture in the frame, wherein, when the lever is in the first position, the detent pin is at a first position in the arc-shaped aperture and when the lever is in the second position, the detent pin is at a second position in the arc-shaped aperture.

The flexible stop includes an open ring of spring metal disposed in a ring orifice in the frame. The flexible stop is generally secured in the ring orifice, but is able to compress generally in a plane of the ring. The detent pin is disposed against the flexible stop wherein, as the lever is moved from the first position to the second position, and as the lever is moved from the second position to the first position, the flexible stop compresses and then uncompresses thereby creating a detent wherein the lever snaps as it moves between the positions.

In a preferred embodiment, the mechanism moves a safety from an unlocked position to a locked position. It is intended that the mode selection mechanism be used for substantially any type of firearm, including, for example, pistols (such as the semi-automatic pistol described here) and rifles.

The lever includes may include an ambidextrous lever portion disposed on an opposite side of the frame, where the ambidextrous lever portion is integrally attachable to the lever such that, once attached, the lever and the ambidextrous lever portion move together as a single unit.

In a more detailed embodiment of the present invention, a mode selection mechanism for a firearm includes a lever having an exposed surface for receiving a digit (such as a thumb) of a user and an inner surface. A pivot pin and a detent pin depend from the inner surface of the lever. The pivot pin is generally circular in cross section and extends through a round orifice in the frame. The detent pin extends generally parallel to the pivot pin, the lever pivotable from a first position to a second position about the pivot pin, wherein the detent pin moves in an arc- shaped aperture, wherein, when the lever is in the first position, the detent pin is at a first position in the arc-shaped aperture and when the lever is in the second position, the detent pin is at a second position in the arc-shaped aperture. A flexible stop includes an open ring of spring metal. The flexible stop is disposed in a ring orifice in the frame, wherein the flexible stop is generally secured in the ring orifice, but retaining an ability to compress generally in a plane of the ring. The detent pin is disposed against the flexible stop wherein, as the lever is moved from the first position to the second position, and as the lever is moved from the second position to the first position, the flexible stop compresses and then uncompresses thereby creating a detent wherein the lever snaps as it moves between the positions.

Again, the mechanism moves a safety from an unlocked position to a locked position. It is intended that the mode selection mechanism be used for substantially any type of firearm, including, for example, pistols (such as the semi-automatic pistol described here), shotguns and rifles.

The lever may include an ambidextrous lever portion disposed on an opposite side of the frame, where the ambidextrous lever portion is integrally attachable to the lever such that, once attached, the lever and the ambidextrous lever portion move together as a single unit.

BRIEF DESCRIPTION OF SEVERAL VIEWS OF THE DRAWINGS

The invention will be described in conjunction with the following drawings in which like reference numerals designate like elements and wherein:

FIG. 6*a* is an isometric view of a lever of the mode selection mechanism of the firearm of

FIG. 1;

DETAILED DESCRIPTION OF THE INVENTION

The invention will be illustrated in more detail with reference to the following embodiments, but it should be understood that the present invention is not deemed to be limited thereto.

Figure 1:
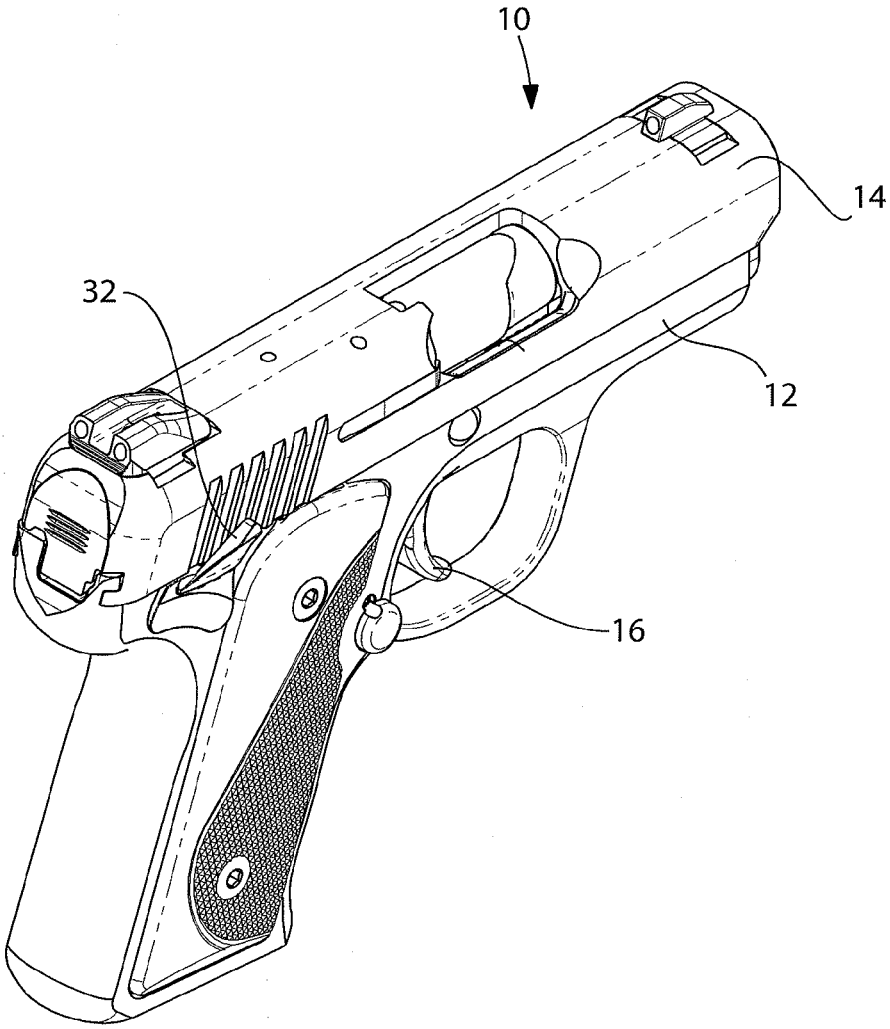
FIG. 1 is an isometric view of a semi-automatic firearm having a firearm mode selection mechanism in accordance with a preferred embodiment of the present invention.
Figure 2:
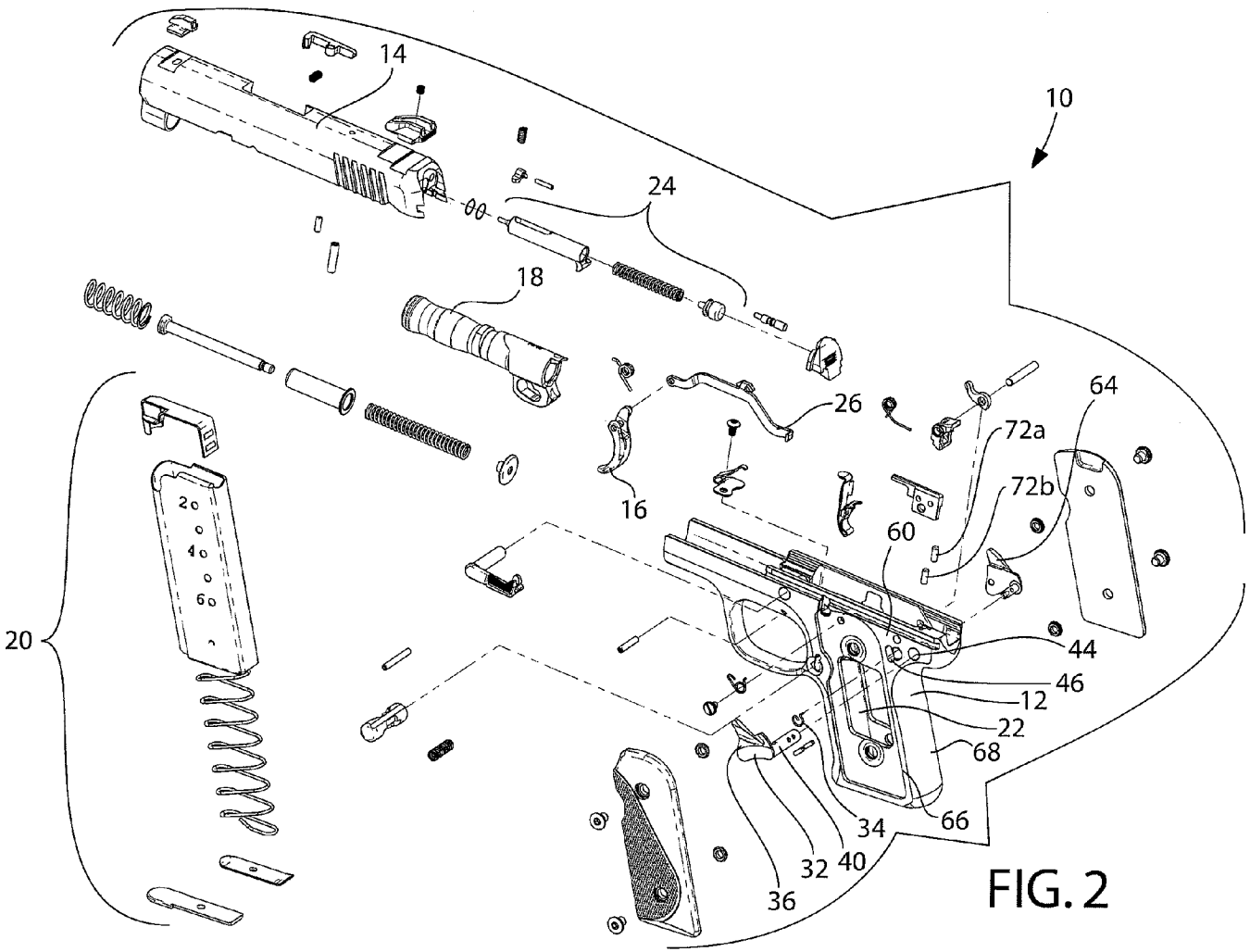
FIG. 2 is an exploded isometric view of the semi-automatic firearm of FIG. 1.
Figure 3:
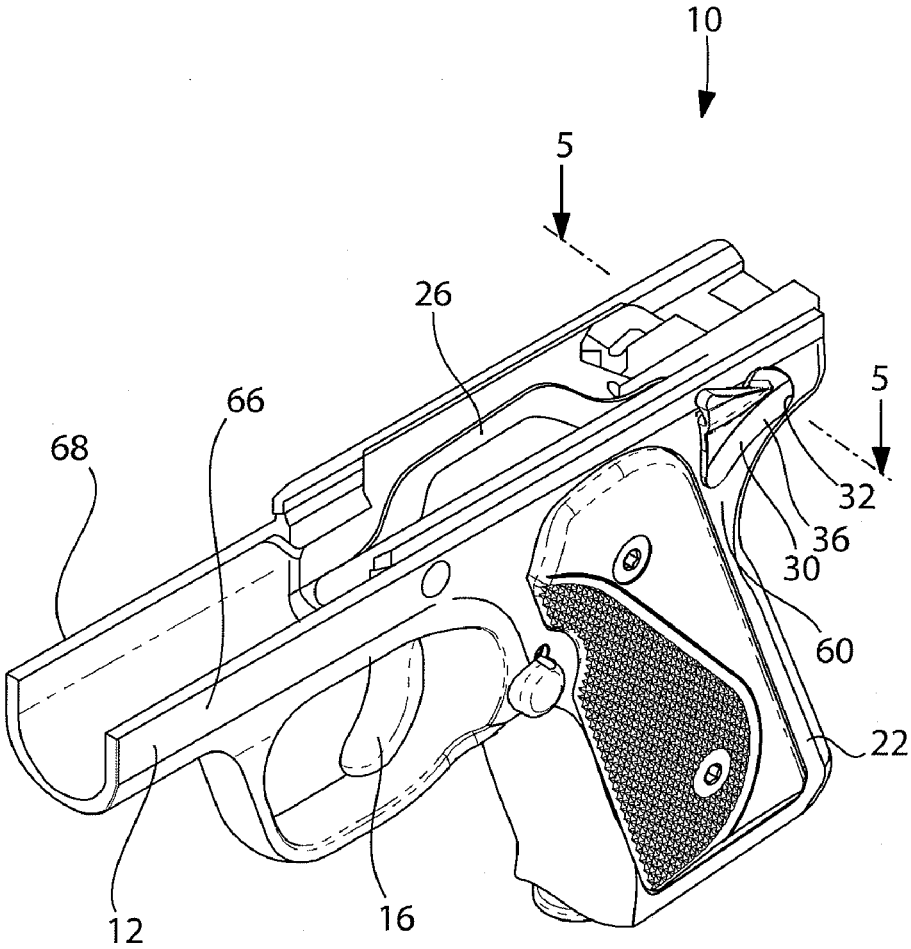
FIG. 3 is an isometric view of the semi-automatic firearm of FIG. 1, with the firearm's slide, barrel and other elements removed for clarity.

Referring now the drawing, wherein like reference numbers refer to like elements throughout the several views, there is shown in FIGS. 1 and 2 a firearm, i.e., pistol 10, having a mode selection mechanism 30 in accordance with a preferred embodiment of the present invention. In this embodiment, the firearm is a semi-automatic pistol, which, as a category, are well known. However, the mode selection mechanism may be used with substantially any type of firearm, including, but not limited to pistols, revolvers, rifles, shotguns and the like.

The pistol 10 of this embodiment includes a frame 12, slide 14, trigger 16, barrel 18 magazine 20, magazine chamber 22, firing pin mechanism 24, trigger bar 26 and various other elements of an automatic pistol, as are well known.

As can best be seen in FIGS. 2, 4, 5, 7*a* and 7*b*, The mode selection mechanism 30 includes a lever 32 and a flexible stop 34, optional ambidextrous lever portion 64 and related features of the frame 12 (as will be discussed in more detail below). The lever 32 has an exposed surface 36 that is disposed on the exterior of the frame 12 adjacent to the trigger 16 for receiving a thumb (or any other digit) of a user. The lever 32 has an inner surface 38. Depending from the inner surface 38 are two pins, a pivot pin 40 and a detent pin 42. The pivot pin 42 is generally circular in cross section and extends through a round orifice 44 in the frame 12 located in a convenient and accessible position to a user. The detent pin 42 extends generally parallel to the pivot pin 40. In the frame 12, adjacent to the round orifice 44, is an arc-shaped aperture 46 that receives the detent pin 42 of the lever 32.

Figure 8A:
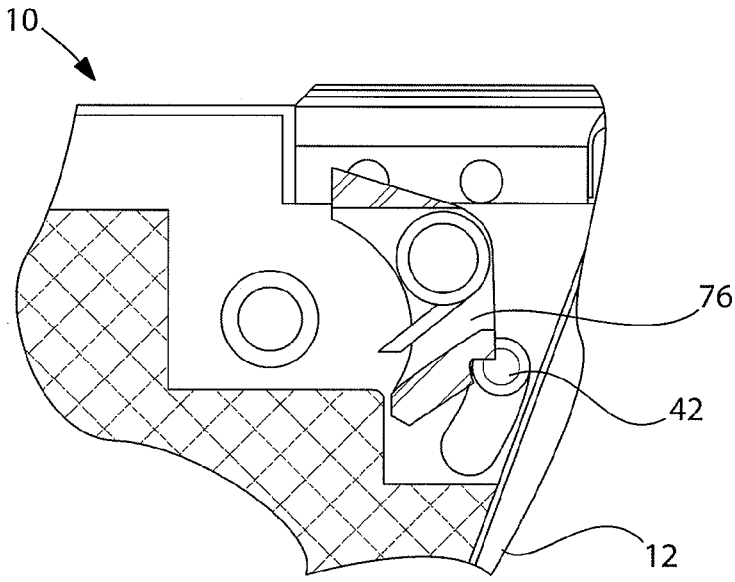
FIG. 8*a* is a simplified cross sectional of the firearm of FIG. 1, shown with the mode selection mechanism for activating and deactivating a safety, wherein the safety is in an on position.
Figure 8B:
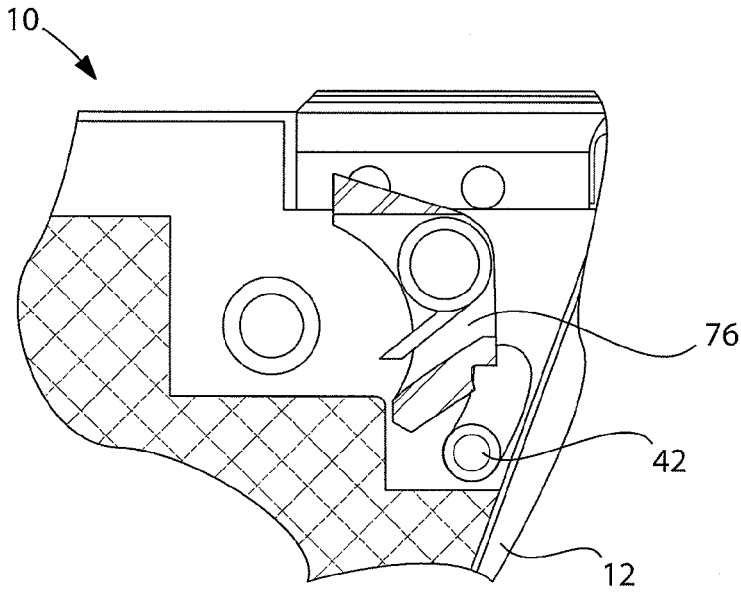
FIG. 8*b* is a simplified cross sectional of the firearm of FIG. 1, shown with the mode selection mechanism for activating and deactivating a safety, wherein the safety is in an off position.

The lever 32 is pivotable about the pivot pin 40 in the round orifice 44 from a first position (see FIGS. 7*a* and 8*a*) to a second position (see FIGS. 7*b* and 8*b*) wherein the detent pin 42 moves in the arc-shaped aperture 46. That is, pivotable movement of the lever 32 is limited by the detent pin 42 being captured within the arc-shaped aperture 46 of the frame 12. When the lever 32 is in the first position of FIGS. 7*a* and 8*a*, the detent pin 42 is at a first position 48 in the arc-shaped aperture 46. When the lever 32 is in the second position of FIGS. 7*b* and 8*b*, the detent pin 42 is at the second position 50 in the arc-shaped aperture 46.

Figure 6A:
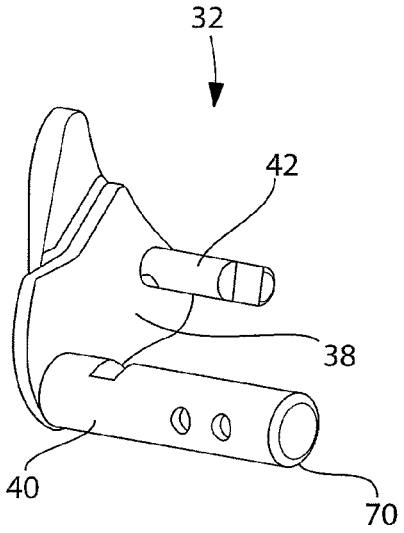
Figure 6B:
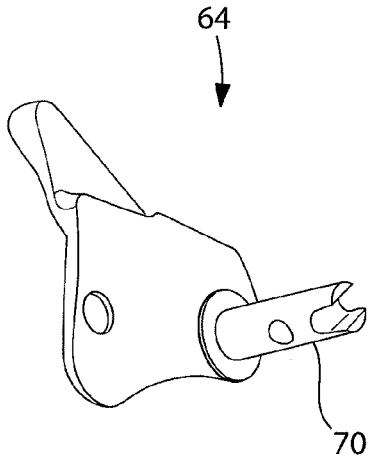
FIG. 6*b* is an isometric view of an ambidextrous lever portion of the mode selection mechanism of the firearm of FIG. 1.
Figure 6C:
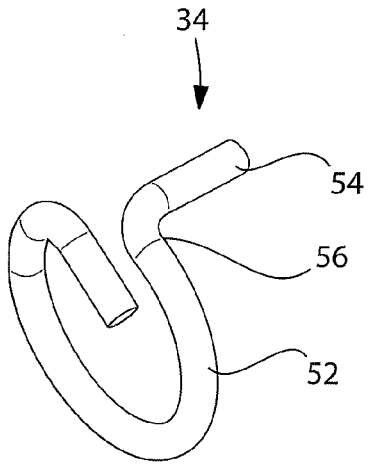
FIG. 6*c* is an isometric view of a flexible stop of the mode selection mechanism of the firearm of FIG. 1.
Figure 7A:
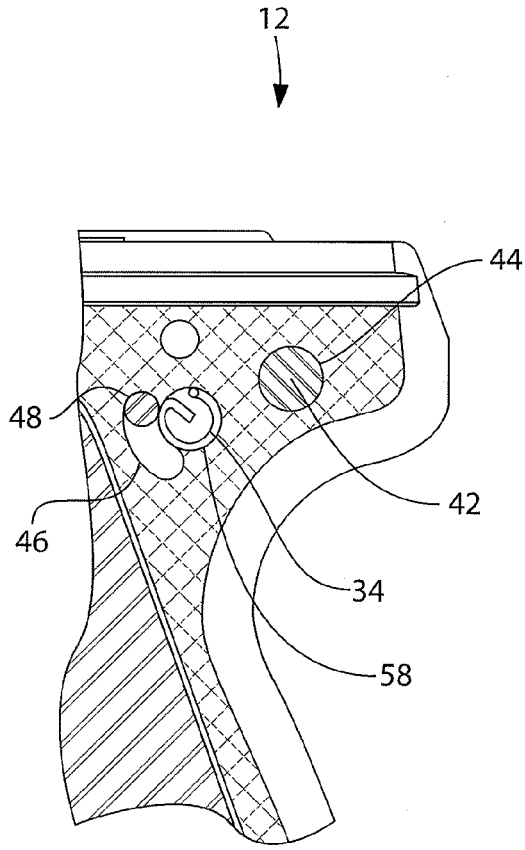
FIG. 7*a* is a side elevation, cross-sectional view of the frame and mode selection mechanism of the firearm of FIG. 1, taken with the slide removed, taken substantially along lines B-B of FIG. 5, with its lever in a first, up, position.
Figure 7B:
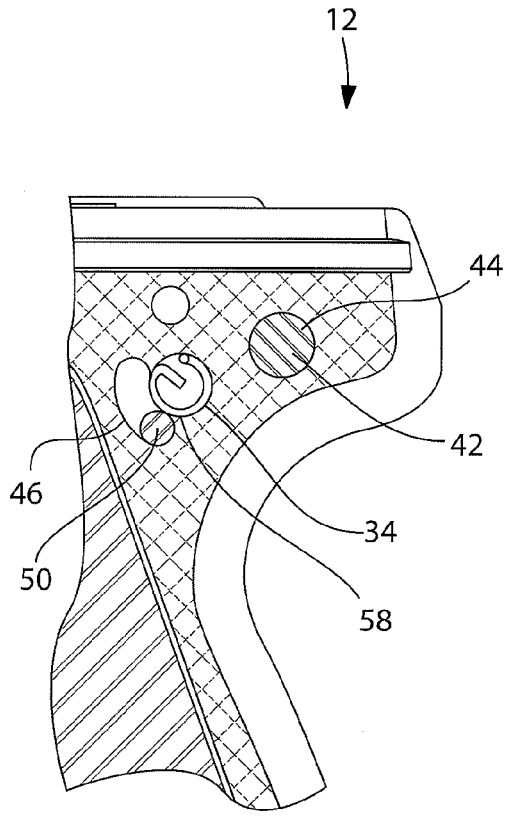
FIG. 7*b* is a side elevation, cross-sectional view of the frame and mode selection mechanism of the firearm of FIG. 1, taken with the slide removed, taken substantially along lines B-B of FIG. 5, with its lever in a second, down, position.

The flexible stop 34 is provided as shown in detail in FIG. 6*c*. Essentially, the flexible stop 34 is a ring 52 made from a spring metal that has an integral leg 54 depending from an end 56 of the ring 52. The leg 54 is preferably generally perpendicular to the ring 52 and is used to secure the flexible stop 34 in a proper position in the frame 12 adjacent to the lever 32 and its arc-shaped aperture 46. The flexible stop 34 is disposed in a ring orifice 58 in the frame 12 where the plane of the ring 52 of the flexible stop 34 is generally parallel to a side 60 of the frame 12. Therefore, the flexible stop 34 is generally secured in the ring orifice 58, but retains the ability to compress generally in a plane of the ring 52.

The detent pin 42 of the lever 32 is disposed against the ring 52 of the flexible stop 34 wherein, as the lever 32 is moved from the first position to the second position (see FIGS. 7*a*, 7*b*, 8*a*, and 8*b*, as described above), and as the lever 32 is moved from the second position to the first position, the flexible stop 34 compresses somewhat and then uncompresses, thereby creating a detent wherein the lever snaps as it moves between the positions.

Figure 4:
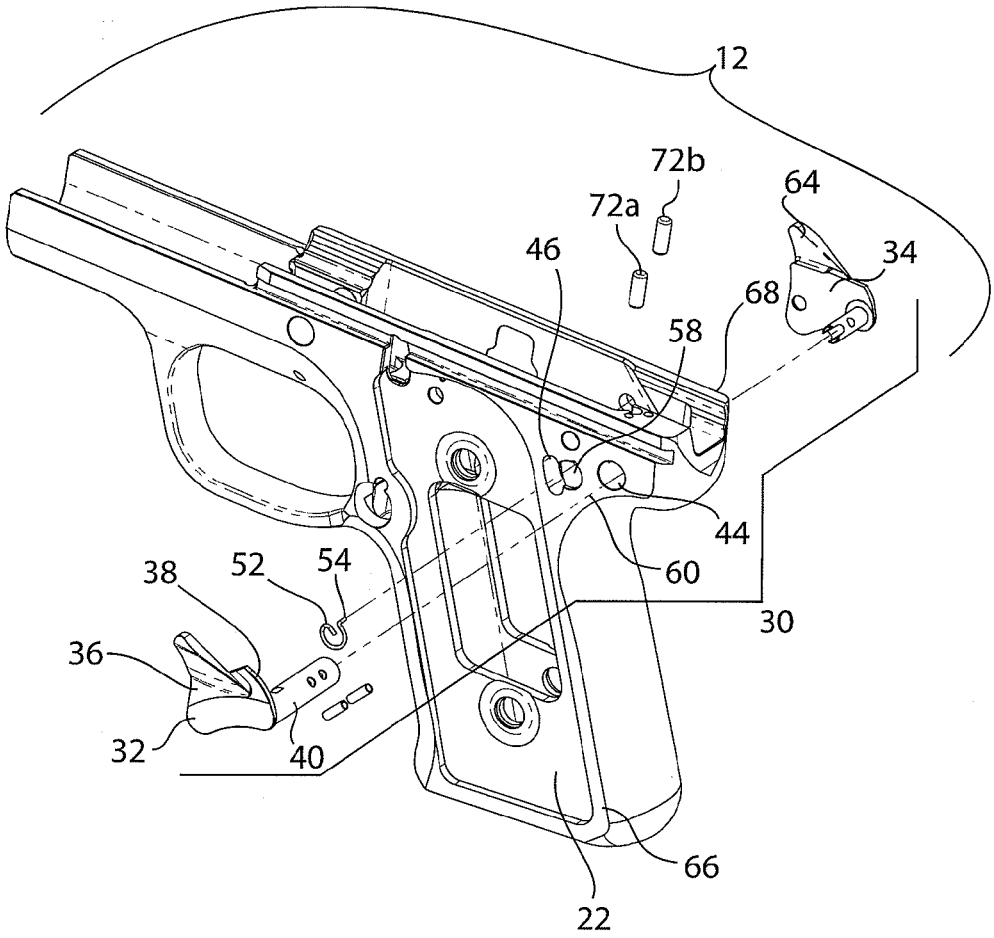
FIG. 4 is an exploded isometric view of a frame and the mode selection mechanism of the firearm of FIG. 1.
Figure 5:
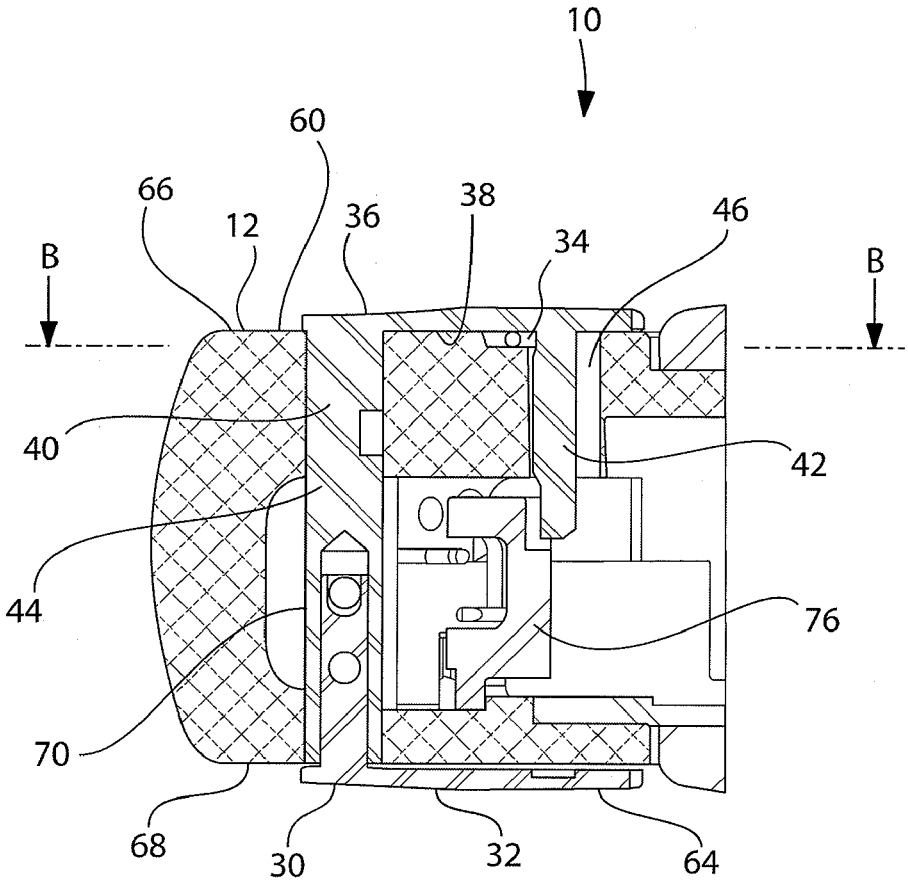
FIG. 5 is a cross-sectional view of the frame and mode selection mechanism of the firearms of FIG. 1, taken substantially along lines 5-5 of FIG. 3.

The lever 32 may be an ambidextrous lever as best shown in FIGS. 4 and 5. Here, the round orifice 44 in the frame 12 extends entirely through the frame 12. Here, the lever 32 has an ambidextrous lever portion 64. The lever 32 is placed through the round orifice 44 on the left side 66 of the frame 12 and the ambidextrous lever portion 64 is placed through the round orifice 44 on the right side 68 of the frame 12. The lever 32 and the ambidextrous lever portion 64 are then integrally attached to one another, in, for example, the hole and pin attachment 70, as best seen in FIG. 4, where the lever 32 and ambidextrous lever portion 64 have mating male and female ends that telescope into one another and are secured to one another with a pair of pins 72*a*, 72*b*, for example, spring pins. Once secured to one another, the lever 32 and the ambidextrous lever portion 64 move together as a single unit.

In a preferred embodiment, the lever 32 and accompanying detent pin 42 of the mode selection mechanism 30 engages the sear 76 to provide a safety from an unlocked position to a locked position. Such a safety can be any of a number of different types for firearms. For the automatic pistol 10, the lever 32 is used as a thumb safety shown in an on position in FIG. 8*a*, and, in the off position in FIG. 8*b*.

While the invention has been described in detail and with reference to specific examples thereof, it will be apparent to one skilled in the art that various changes and modifications can be made therein without departing from the spirit and scope thereof.

What is claimed is:

1. A mode selection mechanism for a firearm, the firearm including a frame, the mode selection mechanism comprising:

(a) a lever having an exposed surface for receiving a digit of a user and an inner surface, a pivot pin and a detent pin depending from the inner surface, the pivot pin extending through a orifice in the frame, the detent pin extending generally parallel to the pivot pin, the lever pivotable from a first position to a second position about the pivot pin, wherein the detent pin moves in an arc-shaped aperture, wherein, when the lever is in the first position, the detent pin is at a first position in the arc-shaped aperture and when the lever is in the second position, the detent pin is at a second position in the arc-shaped aperture, (b) a flexible stop comprising an open ring of spring metal disposed in a ring orifice in the frame, wherein the flexible stop is secured in the ring orifice, but retaining an ability to compress in a plane of the ring;

(c) the detent pin disposed against the flexible stop wherein, as the lever is moved from the first position to the second position, and as the lever is moved from the second position to the first position, the flexible stop compresses and then uncompresses thereby creating a detent wherein the lever snaps as it moves between the positions.

2. The mode selection mechanism for a firearm of claim 1, wherein the mechanism moves a safety from an unlocked position to a locked position.

3. The mode selection mechanism for a firearm of claim 1, wherein the firearm is a semi-automatic pistol.

4. The mode selection mechanism of claim 1, wherein the lever includes an ambidextrous lever portion disposed on an opposite side of the frame, wherein the ambidextrous lever portion is integrally attachable to the lever such that, once attached, the lever and the ambidextrous lever portion move together as a single unit.

5. A mode selection mechanism for a firearm, the firearm including a frame, the mode selection mechanism comprising:

(a) a lever having an exposed surface for receiving a digit of a user and an inner surface, a pivot pin and a detent pin depending from the inner surface, the pivot pin being generally circular in cross section and extending through a round orifice in the frame, the detent pin extending generally parallel to the pivot pin, the lever pivotable from a first position to a second position about the pivot pin, wherein the detent pin moves in an arc-shaped aperture, wherein, when the lever is in the first position, the detent pin is at a first position in the arc-shaped aperture and when the lever is in the second position, the detent pin is at a second position in the arc-shaped aperture, (b) a flexible stop comprising an open ring of spring metal, the flexible stop disposed in a ring orifice in the frame, wherein the flexible stop is secured in the ring orifice, but retaining an ability to compress in a plane of the ring;

(c) the detent pin disposed against the flexible stop wherein, as the lever is moved from the first position to the second position, and as the lever is moved from the second position to the first position, the flexible stop compresses and then uncompresses thereby creating a detent wherein the lever snaps as it moves between the positions.

6. The mode selection mechanism for a firearm of claim 5, wherein the mechanism moves a safety from an unlocked position to a locked position.

7. The mode selection mechanism for a firearm of claim 5, wherein the firearm is a semi-automatic pistol.

8. The mode selection mechanism for a firearm of claim 5, wherein the lever includes an ambidextrous lever portion disposed on an opposite side of the frame, wherein the ambidextrous lever portion is integrally attachable to the lever such that, once attached, the lever and the ambidextrous lever portion move together as a single unit.

* * * * *